US005755047A

United States Patent [19]

Foscaro et al.

[11] Patent Number: 5,755,047

[45] Date of Patent: *May 26, 1998

[54] SPORTS SHOE WITH A REINFORCING SHELL-FRAME

[75] Inventors: Giancarlo Foscaro, Treviso; Mirco Tesser, Montebelluna; Mirco Battistella, Spresiano; Mirco Bergamin, Castelfranco; Gilberto Canil, Noale, all of Italy

[73] Assignee: Nordica S.p.A., Trevignano, Italy

[ * ] Notice: The term of this patent shall not extend beyond the expiration date of Pat. No. 5,588,228.

[21] Appl. No.: 728,462

[22] Filed: Oct. 10, 1996

Related U.S. Application Data

[63] Continuation-in-part of Ser. No. 297,277, Aug. 29, 1994, Pat. No. 5,588,228.

[30] Foreign Application Priority Data

Sep. 10, 1993 [IT] Italy ..... TV93A0080
May 23, 1994 [IT] Italy ..... TV94A0057

[51] Int. Cl.[6] ..... A43B 7/20; A43B 5/04; A43B 5/16

[52] U.S. Cl. ..... 36/118.2; 36/117.1; 36/89

[58] Field of Search ..... 36/89, 2.5, 117.1, 36/118.2, 117.2, 117.3, 117.8, 118.8, 118.7, 117.7

[56] References Cited

U.S. PATENT DOCUMENTS

| | | | |
|---|---|---|---|
| 3,636,642 | 1/1972 | Walther | 36/117.4 |
| 3,807,062 | 4/1974 | Spier | 36/117.2 |
| 4,825,566 | 5/1989 | Sartor | 36/117.8 |
| 4,949,479 | 8/1990 | Ottieri | 36/117.3 |
| 4,969,278 | 11/1990 | Ottieri | 36/117.8 |
| 5,054,215 | 10/1991 | Toncl et al. | 36/118.8 |
| 5,105,566 | 4/1992 | Legon | 36/118.7 |
| 5,152,082 | 10/1992 | Culpepper | 36/89 |
| 5,189,815 | 3/1993 | Pozzobon et al. | 36/117.3 |
| 5,226,875 | 7/1993 | Johnson | 36/89 |
| 5,365,679 | 11/1994 | Chemello | 36/117.7 |
| 5,438,769 | 8/1995 | Mazzarolo | 36/89 |

*Primary Examiner*—Paul T. Sewell
*Assistant Examiner*—Anthony Stashick
*Attorney, Agent, or Firm*—Guido Modiano; Albert Josif

[57] ABSTRACT

Sports shoe with improved lateral rigidity, including a shell rigid reinforcing frame and a shell soft portion connected to the shell rigid reinforcing frame. The reinforcing frame includes bands of plastic material extending along a first inclined directrix and a second inclined directrix such that open regions are defined in the shell reinforcing frame. The first inclined directrix extends at a foot side from the tip region towards the region lying above the heel region, and the second inclined directrix also extends the foot side from the heel region towards the foot instep region.

66 Claims, 7 Drawing Sheets

201
204
207
219
215
225b
226b
224
227
226a
225a
206
218
214
205

201
204
207
215
217
213
226b
225b
227
224
206
212
216
214
226a
225a
205

1
2
4
10
20
7
17
13
19
15
6
21
16
12
18
14
5

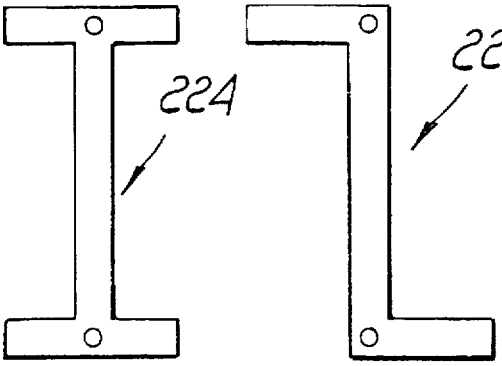
Fig. 7
Fig. 8
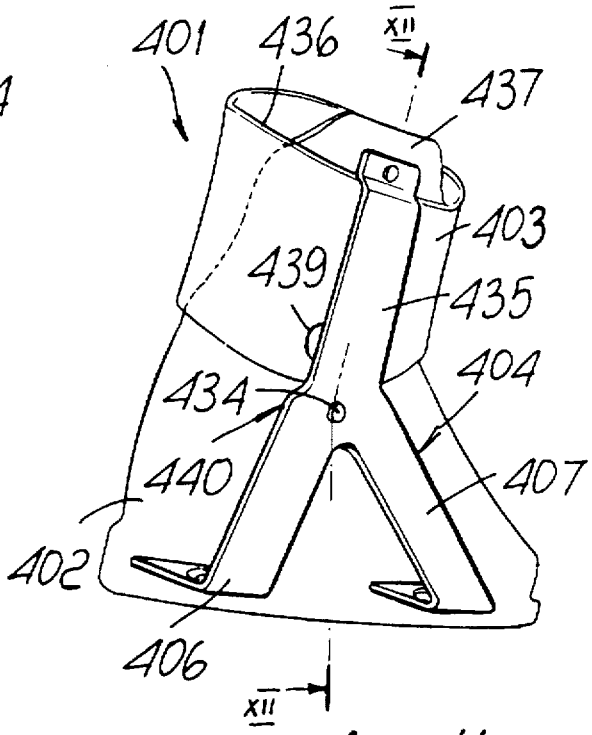
Fig. 11
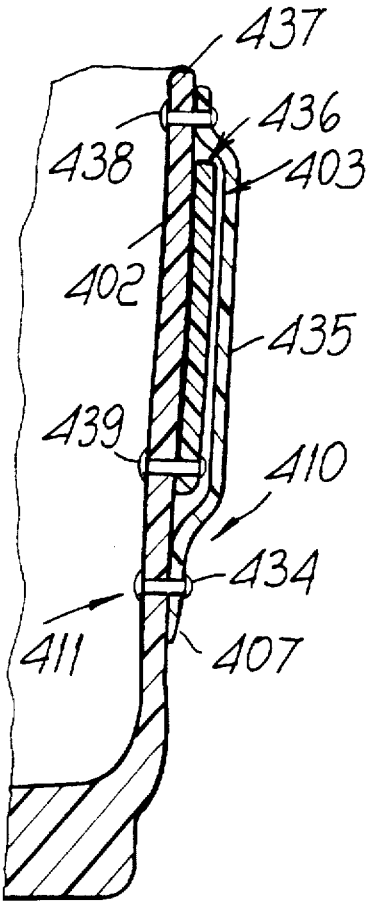
Fig. 12
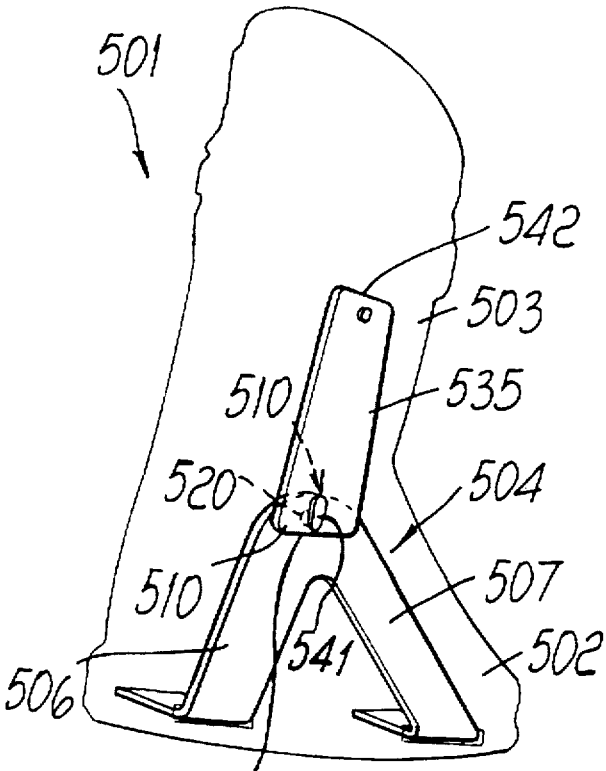
Fig. 13

SPORTS SHOE WITH A REINFORCING SHELL-FRAME

CROSS REFERENCES TO RELATED APPLICATIONS

This is a continuation-in-part of prior application No. 08/297,277, filed on Aug. 29, 1994. Now U.S. Pat. No. 5,588,228 Dec. 31, 1996.

BACKGROUND OF THE INVENTION

The present invention relates to an improved sports shoe with a reinforcing shell-frame.

Sports shoes, such as ski boots, are currently usually produced by injecting plastics at suitable molds in order to obtain a shell and at least one quarter.

For example, French patent no. 2,119,653 discloses a method for manufacturing a ski shoe, comprising a shell and a quarter joined in a single element, which is composed of an outer element and an inner element which are made of two materials and are mutually associated.

The inner element, made of generally rigid plastics, forms at least part of the sole and part of the covering of the ankle and is also open along its front part.

The outer element, made of generally flexible plastics, forms the sole, the front part of the foot, the upper, the heel, a rear part, a covering for the ankle, the foot instep and the part that surrounds the ankle.

This manufacturing method has the drawback that it requires the insertion of the inner element in the outer element.

Furthermore, the inner element has a uniform degree of rigidity in practically all the regions that surround the foot, except for the upper part, so that optimum fit cannot be achieved.

The execution of the inner element by using rigid material furthermore leads to a shoe having a considerable overall weight.

Furthermore, the sole of this shoe which is in contact with the ski is entirely made of rigid plastics, and this further increases the weight of the shoe.

U.S. Pat. No. 3,545,103 discloses a closure device for ski boots comprising a metal side plate that laterally surrounds the outer part of the foot and with which a cuff is rotatably associated.

Although said plate stiffens the boot to a certain extent, it nonetheless does not allow optimum transmission of efforts since it is affected by the tension applied to the lever and affects only the lateral region of the foot.

This allows the leg to move without transmitting the movements to the ski in an optimum manner.

Furthermore, this solution in any case does not allow optimum transmission of efforts from the foot to the ski due to the limited region of the foot affected by the plate.

U.S. Pat. No. 3,067,531 discloses a ski boot composed of a sole to which an inner quarter and an outer quarter are connected; two engagement elements are interposed between said quarters and are arranged longitudinally with respect to them.

The inner and outer quarters are in turn associated, by means of a pivot, to a curved fixed element which is located approximately below the malleolar region, again in the interspace between the two quarters.

This solution, too, has drawbacks, because it does not allow to stabilize the leg, except partially, while skiing; the engagement elements are in fact fixed to the outer quarter at their ends and are thus affected by movements caused by the deformations to which the outer quarter is subjected.

Italian patent no. 1,051,302 discloses a ski boot made of plastics which is essentially constituted by two bodies which mutually overlap along lateral joining lines and are kept in this closed position by fastening means.

The purpose of this solution is to provide a process for manufacturing the boot in a mold without a back draft. The boot comprises parts allowing to adapt it to the devices for fastening it to the ski, as well as a framework formed by thick and rigid ribs and by thin flat portions connecting the ribs.

In any case, even this solution, from the viewpoint of the described technical problem, does not allow to achieve optimum transmission of efforts from the foot to the ski, because the ski is controlled substantially by means of the inner side of the foot, which is not affected by the framework in the illustrated embodiment.

Furthermore, the illustrated embodiment is constituted by multiple elements which must be assembled, thus increasing manufacturing costs.

Furthermore, the arrangement and configuration of the ribs still subjects the boot to slight deformations during sports practice which do not allow optimum transmission of efforts to the ski.

Italian patent application no. 82513 A/87, filed on Feb. 25, 1987 in the name of the same Applicant, discloses a ski boot constituted by a semirigid innerboot with which it is possible to associate at least one first rigid element. The rigid element partially surrounds the lower and lateral regions of the semirigid innerboot. Two second rigid elements are arranged at the sides of the semirigid innerboot and are rotatably associated with the first rigid element and articulated thereto.

This solution was designed specifically for use together with a central binding rigidly coupled to the ski; coupling between the binding and the boot occurred by means of a lateral engagement. Accordingly, this solution is specific for a particular type of coupling to a ski binding and cannot be transferred directly to a conventional ski boot. This solution is essentially constituted by three rigid elements which must be coupled to each other and to the semirigid innerboot.

This would therefore lead to an increase in manufacturing costs, and the presence of articulations in any case would not allow high-efficiency transmission of efforts for optimum ski control.

French patent no. 2,629,691 discloses a ski boot comprising an articulation, in the form of rivets, located at the front articulation of the foot, and a shell which oscillates at the articulation, where the boot is constituted by a rigid part that affects the tip and the sole of the foot.

A quarter is rotatably associated with the shell and a securing device allows to close the instep together with the heel and the ankle.

The structure also comprises external supports which protrude laterally with respect to the rigid part starting 30 from the regions of the tip and of the heel and converge so as to form an essentially triangular structure, approximately at the upper end of the quarter and thus above the point where said quarter is articulated to the shell.

Devices for adjusting the movement and inclination of the quarter can also be associated at the apex of the triangles.

This solution has some drawbacks: first of all it entails a complicated constructive embodiment for the boot, the purpose whereof is mainly to allow the skier to jump more easily and more naturally while skiing by virtue of the particular articulation of the shell and of the rigid element at the tip.

The shape of the rigid structure thus mainly acts as a guide and articulation for the shell during jumps, whereas the outer supports do not allow optimum transmission of efforts from the foot to the ski, since the heel region is free and the quarter is slideable with respect to said supports.

European patent no. 466,032 discloses the assembly of a boot which combines a flexible shoe, to allow walking, with a frame for the flexible shoe which is associable with the bindings of a ski.

The frame has a single plate, which acts as a sole, interacts with the ski bindings, and has a hollow tip and means for connection to the shoe. Two mutually articulated arms also protrude laterally from the plate, and the upper arm frontally surrounds the tibial region of the shoe.

Even this solution is constructively very complicated and is specifically designed to allow the skier to walk easily once sports activity has ended.

However, the transmission of efforts from the leg to the ski is not ideal because the shoe is not directly connected to the ski bindings and because there are plays in the points for connection to the frame. International Patent Application No. WO 92/16120 discloses a ski boot comprising a support that can be fixed to the leg above the ankle and is connected to the sole by means of a bar. The support is shaped like a mask that can be fixed to, and cooperates with, at least one part of the shell and is connected to the bar, preferably at a level located between two closed portions of said mask, by means of a bracket that approximately comprises half of the circumference of the leg.

Even this solution is not optimum as regards the transmission of efforts directly to the ski, since it is again constituted by multiple elements coupleable to each other, to the shell, and to the quarter of the boot.

Furthermore, it is noted that the bar is laterally provided with two arms the lower parts whereof are associated at the heel region of the shell.

This solution is not ideal for transmitting efforts to the ski, because this arrangement produces moments that can open out the curve or in the limit produce windmilling.

In connection to the described technical problem, this same Applicant filed an Italian patent application, no. 82601 A/90, disclosing a quarter associated with the shell and having a slot at its lateral regions which has the same or a different inclination, with respect to a guide formed on the shell. A slider is slidingly associated between the slot and the guide.

This solution, too, has drawbacks due to the fact that the quarter is laterally pivoted to the shell by means of studs or by means of a cross-member which can be arranged at a seat formed transversely and below the sole.

On one hand, the quarter in fact has no particular lateral rigidity characteristics due to the material of which it is normally made, and on the other hand the oscillation it can perform does not allow optimum transmission of efforts to the ski, since the function related to varying the inclination obtainable for said quarter is privileged.

SUMMARY OF THE INVENTION

The aim of the present invention is to solve the described technical problems, eliminating the drawbacks of the prior art by providing a sports shoe that allows to achieve optimum transmission of efforts from the leg to the sports implement, such as a ski, roller skate, etc.

Within the scope of the above aim, an important object is to provide a shoe which is structurally simple but ensures highly efficient transmission of efforts for optimum control of the sports implement and maintains good comfort for the user's foot and leg.

Another object of the invention is to provide a sports shoe that, despite the use of plastics, has the desired degree of stiffness and a low weight.

Another important object is to provide a shoe which associates with the preceding characteristics that of optimizing effort distribution without being excessively stiffened, so as to avoid limiting leg movements during sports practice.

Another object is to provide a shoe which has low manufacturing costs and does not substantially alter, but indeed improves, the overall aesthetic characteristics.

Another object is to provide a shoe that allows the user to customize the degree of transmission of efforts to the sports implement.

According to a preferred aspect of the invention, there is provided a sports shoe including a shell rigid reinforcing frame and a shell soft portion connected to the shell rigid reinforcing frame. The reinforcing frame includes bands of plastic material extending along a first inclined directrix and a second inclined directrix such that open regions are defined in the shell reinforcing frame. The first inclined directrix extends at a foot side from the tip region towards the region lying above the heel region, and the second inclined directrix also extends the foot side from the heel region towards the foot instep region.

BRIEF DESCRIPTION OF THE DRAWINGS

Further characteristics and advantages of the invention will become apparent from the following detailed description of some particular but not exclusive embodiments, illustrated only by way of non-limitative example in the accompanying drawings, wherein:

FIGS. 7 and 8 are views of two different embodiments of the base;

FIG. 11 is a view of another embodiment;

FIG. 12 is a sectional view, taken along the plane XII—XII of FIG. 11;

FIG. 13 is a view of still a further embodiment;

DESCRIPTION OF THE PREFERRED EMBODIMENTS

Figure 3:
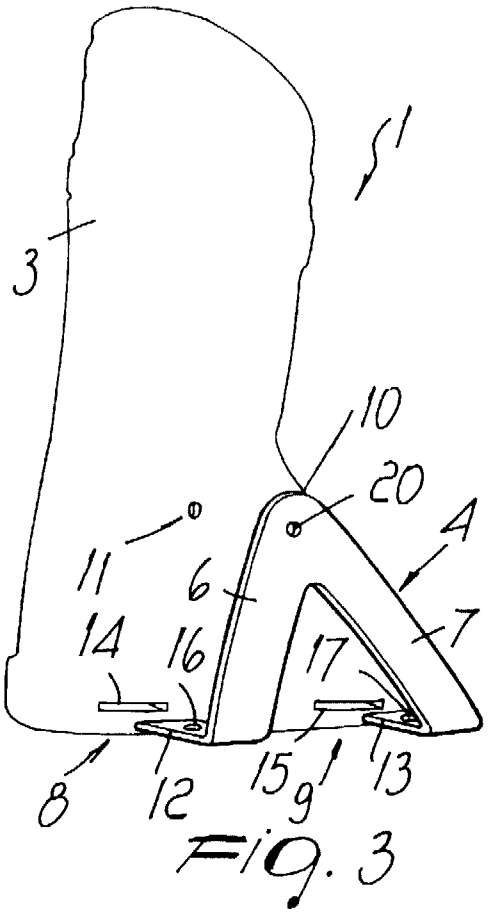
FIG. 3 is a view, similar to FIG. 1, of the rigid element disconnected from the boot.

With reference to the above figures, the ski boot is schematically designated by the reference numeral 1 and is constituted by at least one quarter 3 associated with a shell 2 by means of adapted studs.

The ski boot comprises at least one rigid element, designated by the reference numeral 4, and formed monolithically with the shell 2 or as a separate part.

The material used to produce the rigid element 4 can be 10 the most appropriate according to the specific requirements and can thus have the desired degree of rigidity or elasticity.

If the rigid element 4 is formed by a single part, it is preferably associable at the sole 5 and at the shell 2.

The rigid element 4 is preferably shaped like an inverted V which thus forms a first side 6 and a second side 7 that run respectively from the heel region 8 and from the region 9 of the first and fourth metatarsal bones.

The dimensions of the rigid element 4 are such that its vertex 10 is located approximately at the malleolar region 11.

First tabs 12 and second tabs 13 are associated respectively with the free ends of the first side 6 and of the second side 7, are arranged on a plane which is approximately at right angles to the plane of arrangement of the first and second sides, and protrude towards the shell 2.

The rigid element 4 is preferably applied at the inner side of the foot.

The rigid element 4 is also associable at the sole 5 and at the shell 2, and the first and second tabs can be located inside suitable complementarily shaped first and second seats 14 and 15 formed transversely with respect to the sole 5 at the heel region 8 and at the region 9 of the first and fourth metatarsal bones.

Advantageously, the connection of the rigid element 4 to the shell 2 is temporary, since it is possible to form a first hole 16 and a second hole 17 at the first and second tabs respectively and a third hole 18 and a fourth hole 19 on the sole 5, at the first seat 14 and at the second seat 15, for connection to the first and second tabs by means of suitable screws or rivets.

A fifth hole 20 is formed at the vertex 10 of the rigid element 4 to fix the rigid element 4 to the shell 2 and advantageously to articulate the quarter 3 to the shell 2 approximately at the axis 21 of the malleolus.

In the illustrated embodiment, the rigid element is obtained by means of a shaped plate, but it can be formed using the most suitable shape according to the specific requirements and thus can be formed by using a rod.

A feature of the rigid element 4 resides in that its first side 6 and its second side 7 are arranged in directions along which efforts extend and are transmitted from the leg/foot unit to the binding/ski assembly through the boot.

The rigid element, and the first and second sides 6 and 7, which have a greater rigidity than the shell, allow optimum transmission of efforts to the sole 5, which can be more rigid than the shell and thus again transmit efforts in an optimum manner directly to the bindings connected to the ski.

Accordingly, the use of the rigid element in plastics materials allows to maintain the comfort which is typical of a conventional boot made of plastics, combining it with the possibility to transmit in an optimum manner the efforts applied by the foot from the foot to the sole of the boot and thus to the ski bindings.

The possibility to temporarily associate the rigid element with the shell also allows the user to change the rigid element according to his specific anatomical characteristics or according to his skill level in skiing technique.

The shape of the rigid element, which thus substantially affects the heel region, the region of the first and fourth metatarsal bones, and the malleolar region, is such as not to interfere with the other characteristics of the boot, for example with the oscillating movement of the quarter and therefore also with the walking period that follows sports practice.

It has thus been observed that the invention has achieved the intended aim and objects, a sports shoe having been provided wherein the rigid element extending from the malleolar regions to the regions of the heel and of the first and fourth metatarsal bones, allows, by virtue of the connection of said rigid element to the shell and to the sole, optimum transmission of efforts from the leg and from the foot to the sole and thus, by means of the bindings, to the sports implement, allowing the user to select the transmission strength according to his/her anatomical or technical requirements.

This solution thus allows to transmit efforts with high efficiency from the leg to the sports implement, since the rigid element lies along the main directrices of the efforts.

The rigid element also does not interfere with the accessory functions of the shoe, such as, for example in the case of ski boots, the pivoting of the quarter to the shell or the level of comfort for the skier's leg.

The rigid element is also structurally very simple and can be associated in an equally simple manner at the sole and at the shell so that it can even be optionally easily replaced by the skier.

The rigid element therefore is also an aesthetic element that can be customized by the user.

The shoe according to the invention is susceptible to numerous modifications and variations, all of which are within the scope of the same inventive concept.

Figure 2:
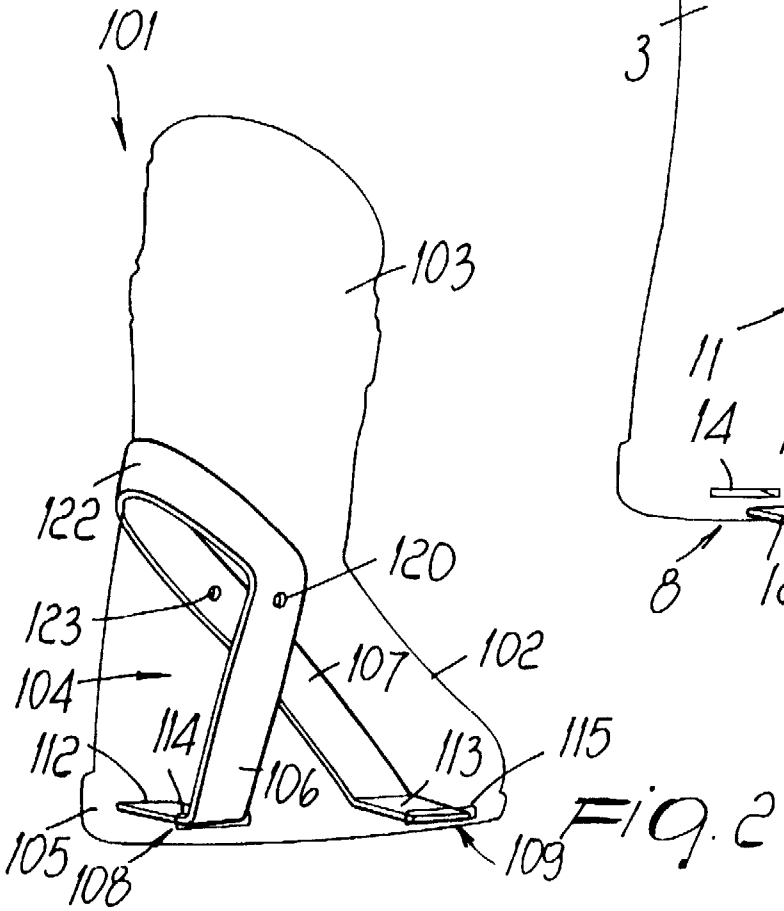
FIG. 2 is a view, similar to the preceding one, of a second embodiment of the invention.
Figure 1:
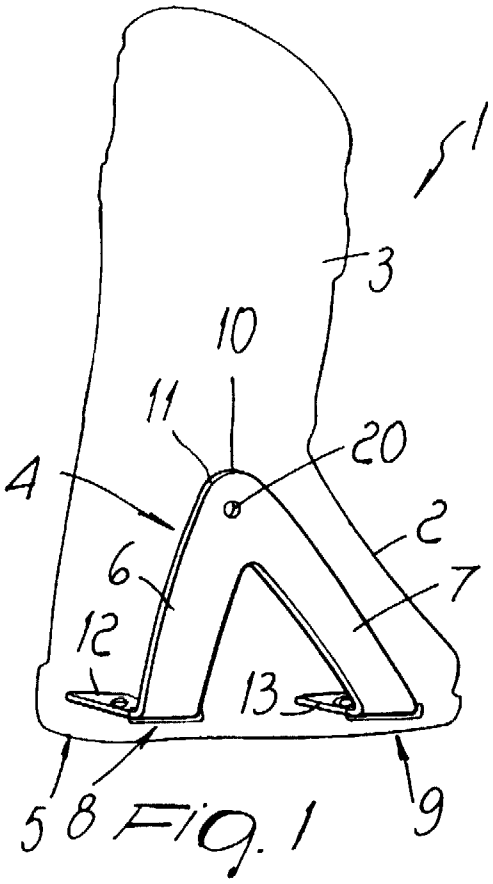
FIG. 1 is a lateral perspective schematic view of a ski boot according to the invention.

Thus, for example, FIG. 2 illustrates a ski boot 101 which is again composed of at least one quarter 103 articulated to a shell 102 and wherein the rigid element 104 has a first side 106 which has a first tab 112 that can be arranged at an adapted first seat 114 formed on the sole 105 at the heel region 108.

A curved band 122 is associated with the end of the first side 106 that lies opposite to the first tab 112, after the fifth hole 120 for fixing the rigid element 104 to the shell 102. The band is also rigid and surrounds the shell 102 to the rear until it reaches a sixth hole 123 which preferably has the same axis as the fifth hole 120.

The band 122 is then connected to the second side 107, which has a second tab 113 that can be arranged at an adapted second seat 115 formed on the sole 105 of the shell 102 at the region 109 of the first and fourth metatarsal bones.

In this case, part of the band 122 and the second side 107 affect the outer side of the foot. Of course, the rigid element 104 can be given a mirror-symmetrical structure, wherein the second side 107 affects the inner part of the foot and the first side 106 affects the outer part.

The band 122 also forms a rear support for the foot in any case.

Figures 4, 5, 6:
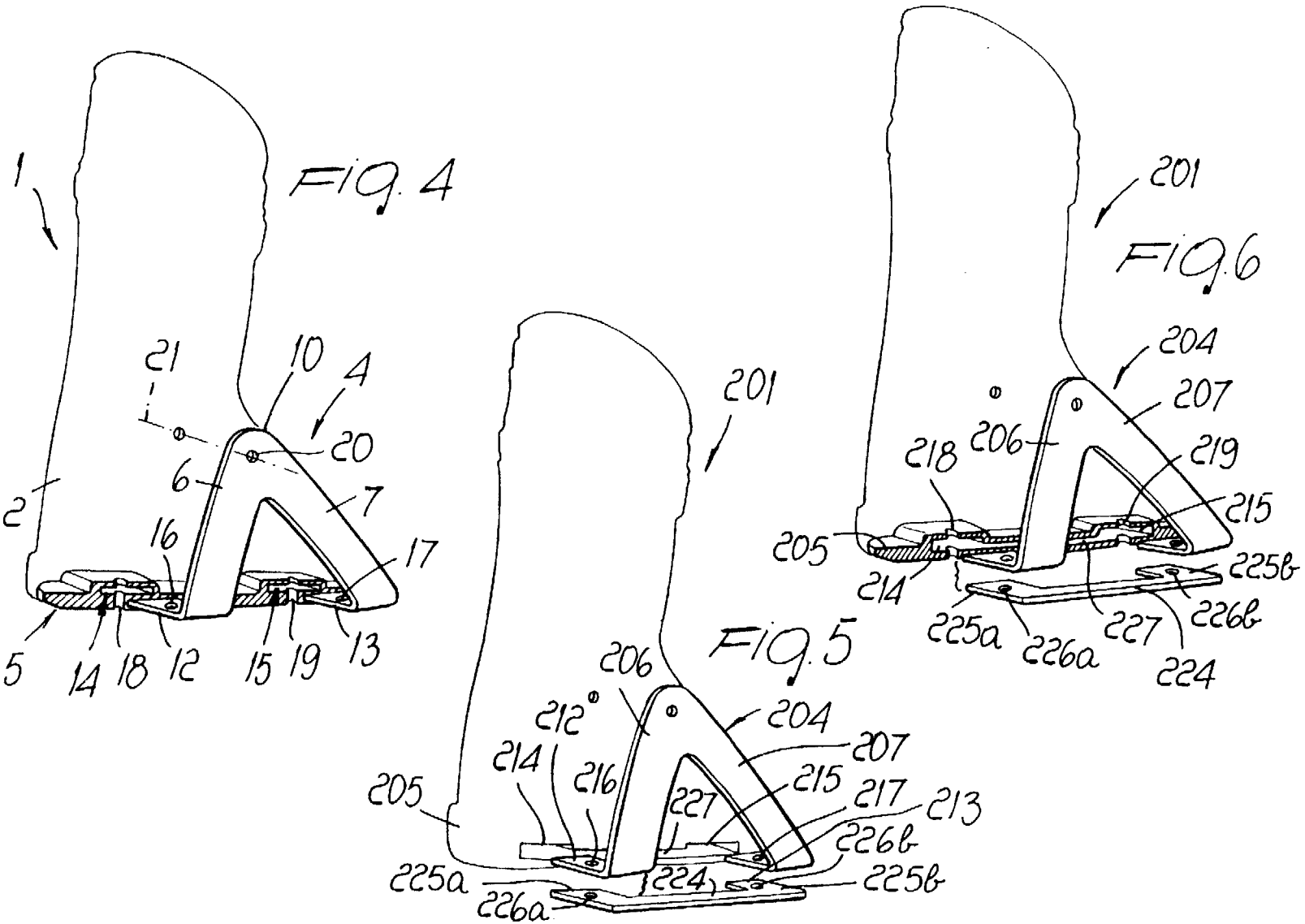
FIG. 4 is a view, similar to the preceding one, of a particular connection of the rigid element to the sole of the boot.
FIG. 5 is a view, similar to FIG. 3, of another embodiment of the invention.
FIG. 6 is a view, similar to FIG. 4, of the invention in the embodiment shown in FIG. 5.

FIGS. 5 and 6 illustrate another embodiment of a ski boot 201, wherein the rigid element 204 still comprises a first side 206, second side 207, first tabs 212, second tabs 213, and also a bar 224. Also bar 224 is rigid and is essentially C-shaped. Bar 224 can be arranged below the sole 205, in order to give greater torsional rigidity to the sole of the boot.

Said bar 224 has a longitudinal extension that is equal to the interspace between the first and second tabs. Adapted seventh holes 226*a* and 226*b* are formed on said bar at the tabs 225*a* and 225*b* and have an axis that coincides with the axis of the first and second holes 216 and 217 and of the third and fourth holes 218 and 219.

As an alternative, the bar 224 can be arranged at an adapted third seat 227 which is connected to, and joins, the first seats 214 and the second seats 215 so that it is located inside the sole 205.

Of course it is possible to provide different shapes for the bar 224, such as a double-T or Z-like shape, as shown in FIGS. 7 and 8, which in any case can give the sole greater torsional rigidity.

The bases can, for example, be associated below the sole at adapted seats formed therein.

Figure 10:
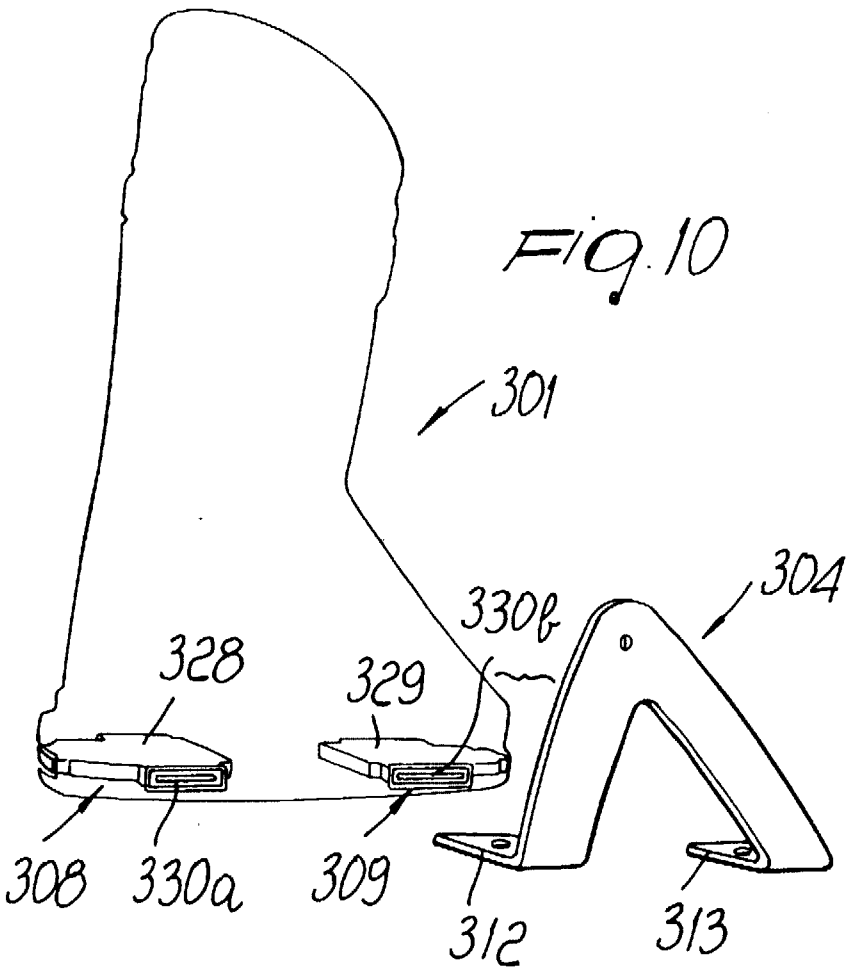
FIG. 10 is an exploded view of the invention shown in FIG. 9.
Figure 9:
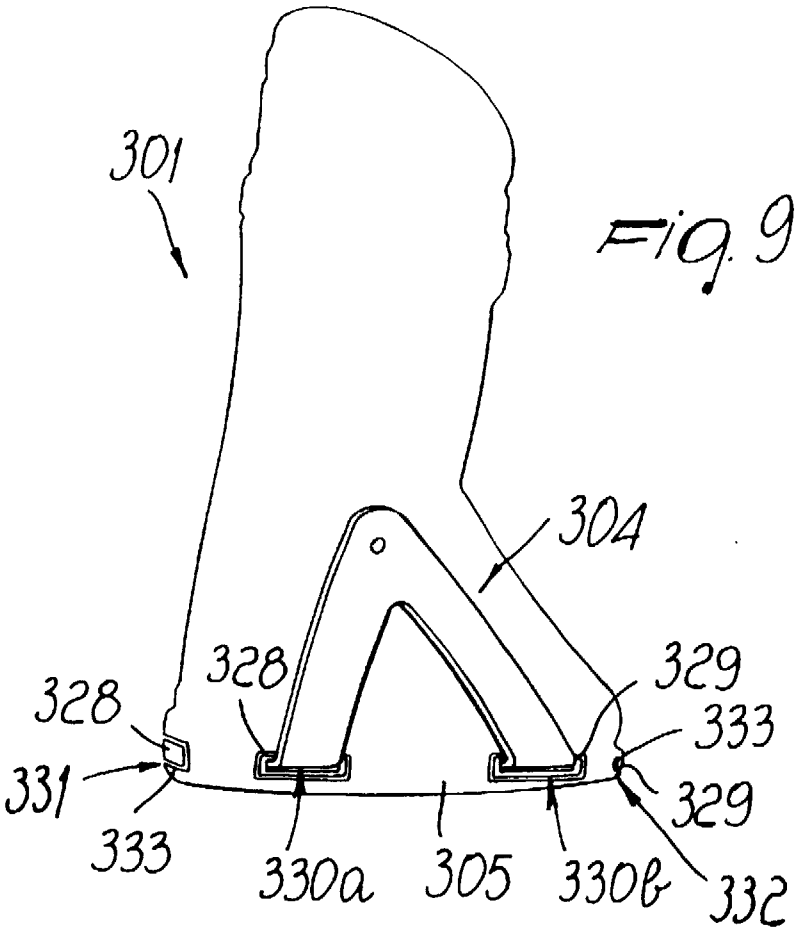
FIG. 9 is a view, similar to FIG. 1, of the rigid element shown in FIG. 4, in a further embodiment for connection to the sole of the boot.
Figures 14, 15, 16:
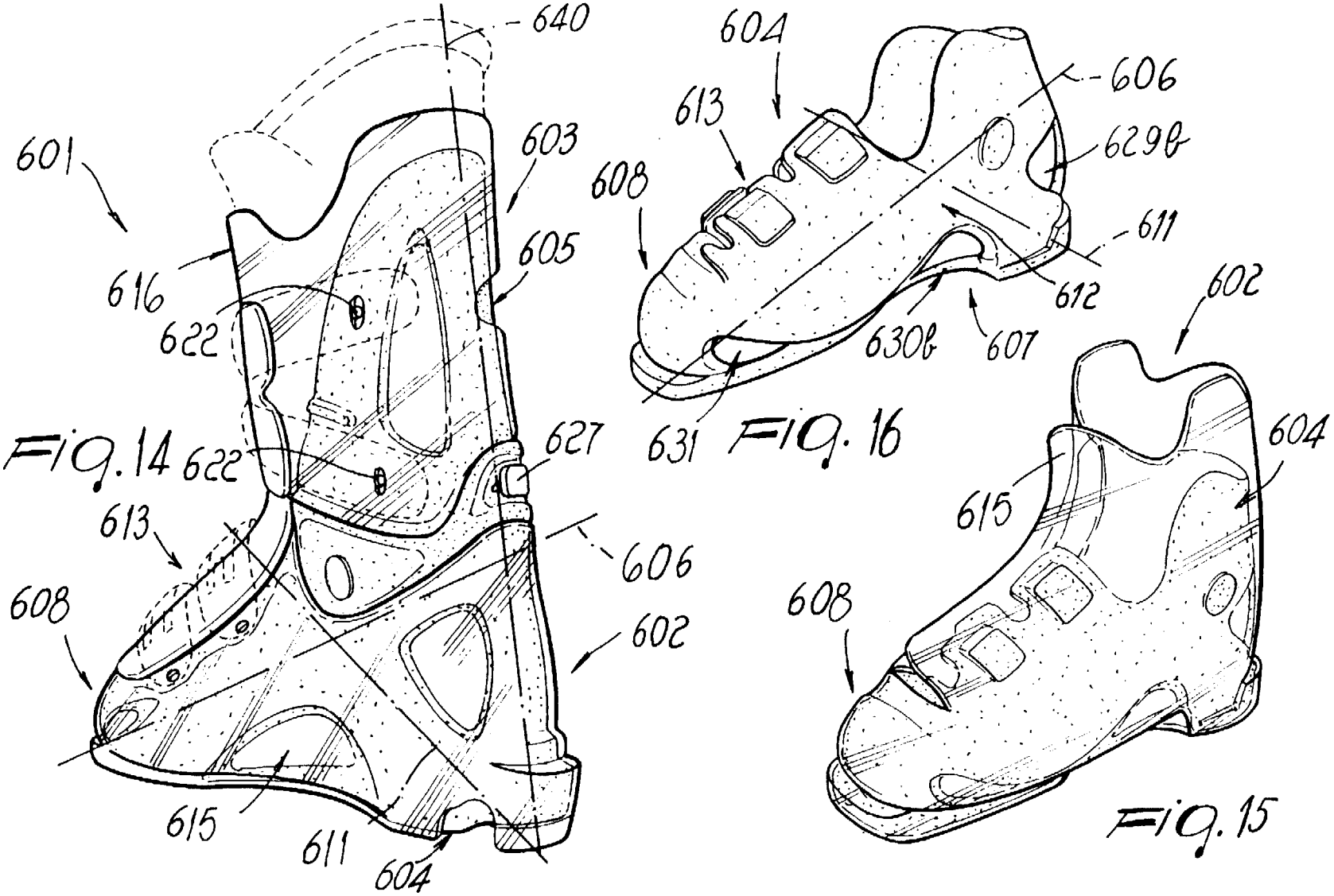
FIG. 14 is a rear perspective view of a ski boot according to a further embodiment of the invention.
FIG. 15 is a lateral perspective view of the shell with the soft covering element associated therewith according to the embodiment of FIG. 14.
FIG. 16 is a view, similar to the preceding one, of the rigid grid-like frame of the shell on its own.

FIGS. 9 and 10 illustrate another embodiment of a ski boot 301 wherein the rigid element 304 has first tabs 312 and second tabs 313 which can be arranged at an adapted first insert 328 and at a second insert 329. Inserts 328 and 329 can be arranged inside the first seats 314 and the second seats 315 formed at the heel region 308 and at the region 309 of the first and fourth metatarsal bones.

Of course, the first tabs 312 and the second tabs 313 can be arranged within adapted slots 330*a* and 330*b*, formed on the surfaces of the first and second inserts which face them.

The first and second inserts can have such a shape that they can partially protrude at the heel 331 and/or at the toe 332 and/or at the other side of the sole 305, by means 20 of adapted additional fourth seats 333, formed on said sole 305.

The purpose of the first and second inserts is to transmit efforts from the foot to the ski in an even more effective manner, since the rigid structure, constituted by the element 304 and by the inserts 328 and 329, reaches the region for connection to the bindings.

FIGS. 11 and 12 illustrate a boot 401 wherein the rigid element 404 is Y-shaped, with the vertex 410 of the first side 406 and of the second side 407 again arranged at the malleolar region 411 and associated in said region with the shell 402 for example by means of a first rivet 434.

The rigid element 404 also has a stem 435 that extends from the vertex 410 longitudinally with respect to the stem 403 until it protrudes beyond the upper perimetric edge 436 of said quarter and is then associated with a third tab 437 of the shell 402 by means of a second rivet 438.

As an alternative, the end of the stem 435 may be disconnected from the shell or may be connected both to the shell and to the quarter, an adapted slot being formed on said quarter to allow its rotation, about an axis centered on the studs 439, with respect to said shell.

FIG. 13 illustrates a ski boot 501 wherein the rigid element 504 is again Y-shaped but wherein the stem 535 is separate and associated with the first side 506 and with the second side 507, at the fifth hole 520 formed on the vertex 510.

The stem 535 is thus constituted by a plate on a first end 540 whereof there is a longitudinal slot 541 for articulation to the shell 502 at the fifth hole 520.

The second end 542 of the stem 535 is instead fixed to the quarter 503.

The slot 541 allows to vary, with adapted per se known means, the lateral inclination of the quarter with respect to the shell, known as "canting".

With reference to FIGS. 14–20, the reference numeral 601 designates a ski boot constituted by a quarter 603 associated with a shell 602.

In the particular illustrated embodiment, both parts have a first reinforcing rigid grid-like frame 604 and a second reinforcing rigid grid-like frame 605.

The first rigid grid-like frame 604, which belongs to the shell 602, lies along first directrices 606 which are inclined with respect to the resting surface or extension of the sole 607 and connect the region 608 of the tip of the sole 607 to the region 609 that lies above the heel 610 of the foot.

The first directrices preferably affect both sides of the first grid-like frame 604.

The frame also has second directrices 611 which are inclined with respect to the resting surface of the sole 607 and connect the region 612 which is adjacent to the heel of the sole 607 to the first directrices 606 towards the foot instep region 613.

The second directrices 611, in order to cross the first directrices 606, accordingly form an acute angle with respect to the resting surface of the sole 607, assuming a clockwise rotation to be positive.

Figures 17, 18:
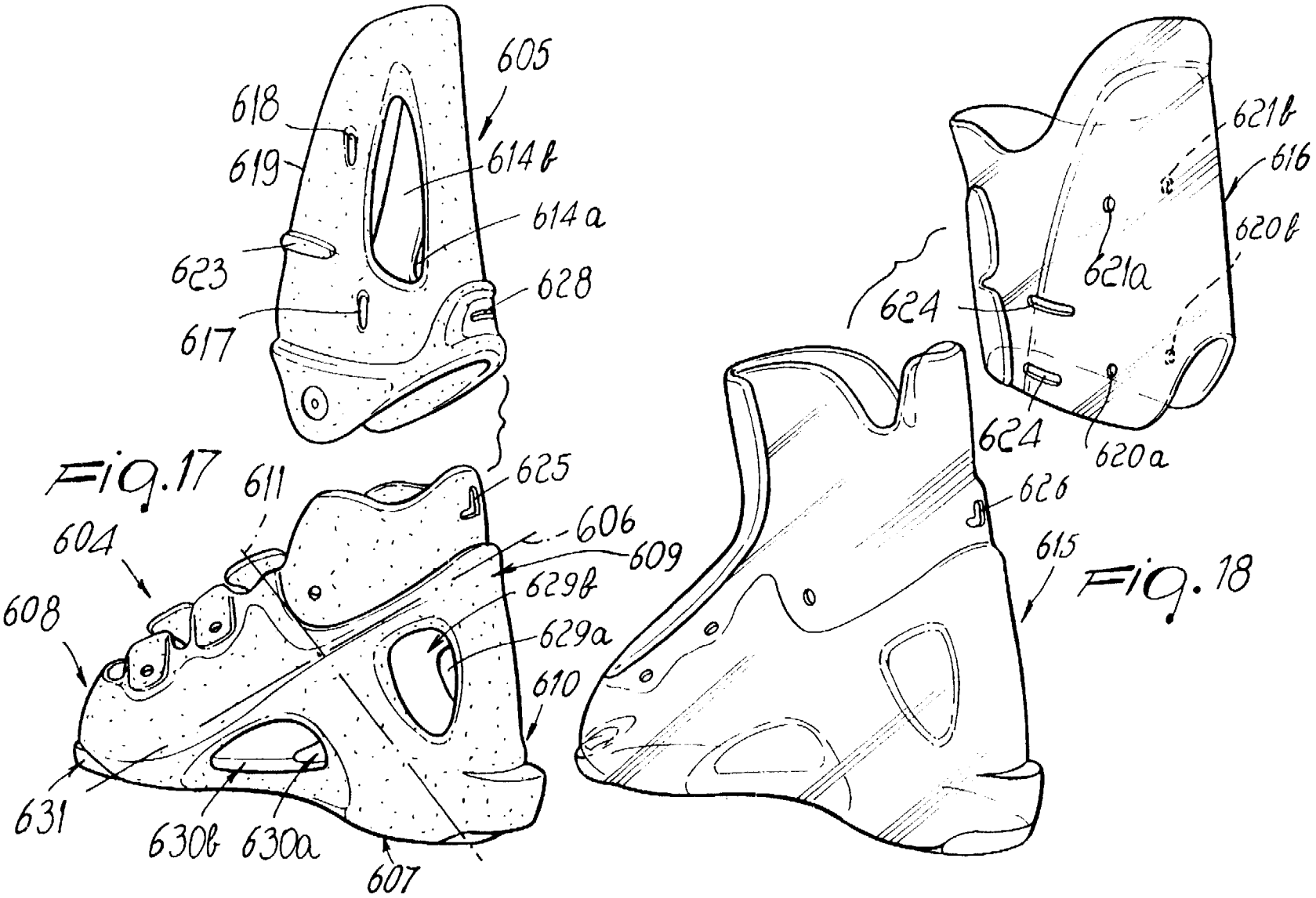
FIG. 17 is an exploded perspective view of the grid-like rigid frames that form the shell and the quarter.
FIG. 18 is a view, similar to the preceding one, of he soft covering elements for the shell and the quarter.
Figure 19:
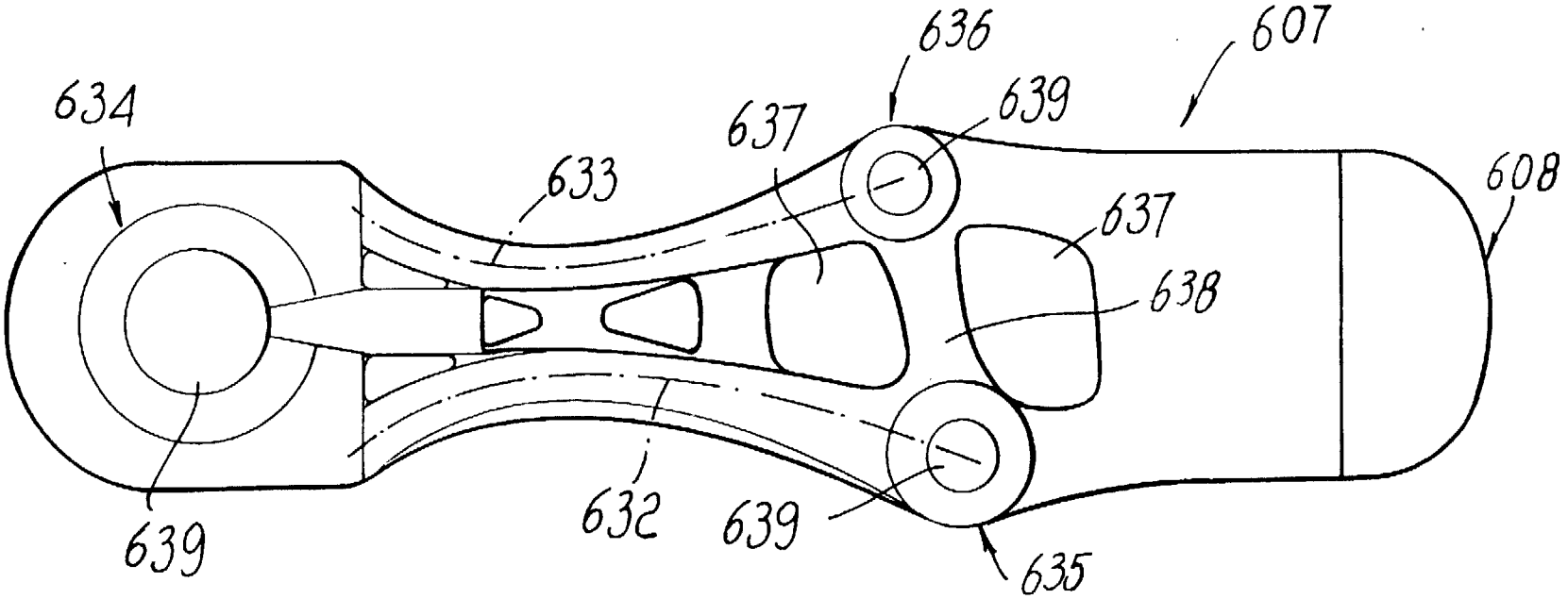
FIG. 19 is a plan view of the sole.
Figure 20:
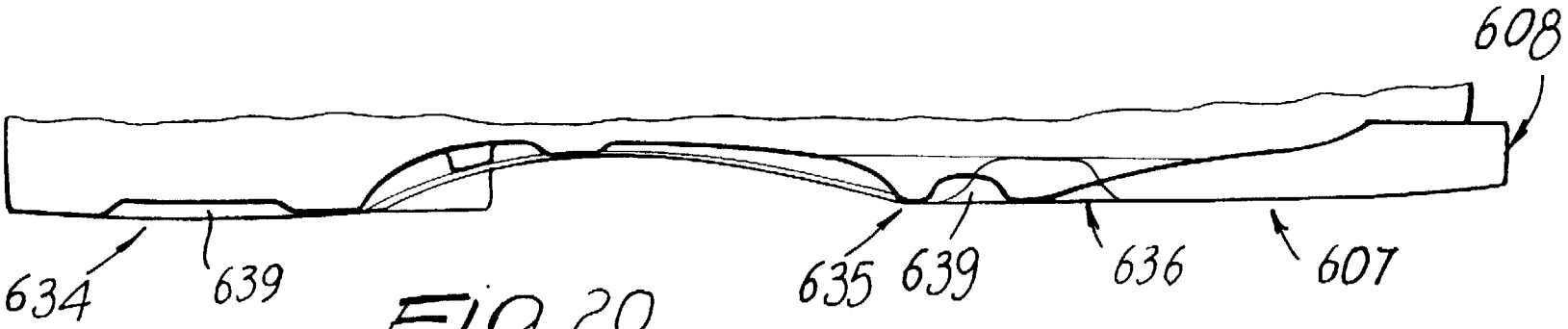
FIG. 20 is a side view of the sole shown in the preceding figure.

As regards the second grid-like frame 605 that belongs to the quarter 603, it has at least two lateral openings 614*a* and 614*b* having, in the particular embodiment, an essentially teardrop-like shape the longitudinal axis whereof is essentially vertical with respect to the ground. In the embodiment as seen in FIG. 17, the second grid-like frame 605 is provided with a band of plastic material extending along the rear directrix at a calf region of the shoe such that the band extending at the rear directrix is connected to two bands of plastic material extending at the opposite lateral areas and such that the pair of lateral openings 614*a* and 614*b* are delimited by the bands extending at the opposite lateral areas and by the band extending at the rear directrix. It is alternatively possible to form the second frame 605 without the band extending at the rear directrix, such that an open calf region is defined at the calf region of the shoe, which open calf region is connected to the pair of lateral openings to form a single open region which comprises the open calf region and the pair of lateral openings, and such that said single open region is delimited by the bands extending along the opposite lateral areas.

The shell 602 and the quarter 603 are also constituted by a first covering element 615 and by a second covering element 616 which are soft and are injected in place or associated at said first frame and at said second frame respectively.

If the second covering element 616 is associated with the second grid-like frame 605 by means of a mechanical connection, it is advantageously possible to provide, at the second grid-like frame 605, guiding and/or centering means for the second soft covering element 616 suitable to allow it to slide with respect to the second grid-like frame 605.

The means can be constituted for example by a first pair of slots 617 and by a second pair of slots 618, formed laterally with respect to the second grid-like frame 605, in a region that is adjacent to the perimetric edge 619 of the second frame.

Adapted first pairs of holes 620*a*, 620*b* and second pairs of holes 621*a*, 621*b* are formed at the first and second pairs of slots on the second covering element 616. An adapted pivot 622 can be arranged at said first and second pairs of slots and at said first and second pairs of holes and acts as a guide for the vertical sliding of the second covering element 616 with respect to the second frame 605.

The second frame also has at least two ridges 623 that protrude laterally along an axis which is approximately at right angles to the axis of the first and second pair of slots. Ridges 623 protrude starting from the perimetric edge 619 of the second grid-like frame 605 towards the pair of lateral openings 614*a* and 614*b*.

One of a plurality of suitable third pairs of mutually parallel slots 624 are formed laterally with respect to the second covering element 616 and are shaped approximately complementarily to the ridges 623. Slots 624 interact with the ridges 623 so as to lock the position of the second covering element 616 with respect to the second rigid frame 605.

The skier can thus select the position of the second covering element 616 with respect to the second rigid frame 605, thus obtaining a quarter that can assume different heights according to the requirements of the skier.

It is also possible to provide means for adjusting the inclination of the quarter with respect to the shell. Thus, for example, it is possible to provide, to the rear of the first grid-like frame 604, above the heel region 610, an adapted L-shaped first seat 625 which is matched by a complementarily shaped second seat 626, formed on the first covering element 615.

A fourth slot 628 is formed transversely at the rear region of the second grid-like frame 605 and is arranged at a wing of the first and second seats when the quarter is associated with the shell.

A slider 627 has a stem arranged in the fourth slot 628 as well as in the first seat 625 and in the second seat 626, to vary the inclination of the quarter 603 according to the teachings included for example in the prior European patent EP 0302414 filed by this same Applicant.

The first directrices 606 and the second directrices 611, on the first grid-like frame 604, allow to obtain, in said frame, an adapted second pair of openings 629*a*, 629*b*, a third pair of openings 630*a*, 630*b*, and a fourth pair of openings 631, which are not affected by the directrices and allow savings in the manufacturing costs and in the weight of the shoe.

The rigid frames 604 and 605 are therefore grid-like in that they include bands or strips of material which extend along the various directrices, and openings without material which are arranged adjacent or between the bands extending along the directrices.

Once the first covering element 615 and the first rigid grid-like frame 604 have been associated, the second, third, and fourth pairs of openings are closed, thus obtaining soft regions thereat, for supporting the lateral portions of the foot and of the malleoli.

The ski boot is also constituted by the sole 607, which also has a grid-like configuration by virtue of the presence of a third directrix 632 and of a fourth directrix 633 which have an essentially concave shape and are arranged mutually opposite. The directrices connect the heel region 634 to the region 635 of the first metatarsal bones and the region 636 of the fifth metatarsal bones.

Adapted recesses 637 can also be obtained between the third and fourth directrices to lighten the sole. It is also possible to obtain a bridge 638 for connecting the region 635 and the region 636, as well as an additional recess 637 towards the region 608 of the tip of the sole.

Advantageously, suitable by partially 39 can be formed by partially removing material at the heel region 634 and at the regions 635 and 636.

The first frame 604 and the second frame 605 also have a fifth directrix 640 which extends to the rear of the heel and calf region.

The fifth directrix 640 intersects the first and second directrices at the first frame 604.

The fifth directrix 640 delimits the pair of lateral openings 614*a* and 614*b* at the second frame 605.

It has thus been observed that the invention has achieved the intended aim and objects, a shoe having been obtained which, even with the use of plastics materials, has both optimum characteristics for the transmission of efforts from the foot to the sports implement and optimum fit for the user, by virtue of the presence of the first and second grid-like frames, in plastics materials, and of the first and second directrices.

Furthermore, the lightening recesses of the structure that is obtained are large since they are provided in the regions that are not affected by the transmission of efforts from the foot to the sports implement.

This allows to contain the overall weights of the sports shoe.

It should also be noted that the particular grid-like structure withstands in an optimum manner both torsional and flexural stresses applied, for example while skiing, and can thus reduce the splaying and warping that such stresses generally induce in the structure. This leads to a highly efficient transmission of ski control efforts, thus minimizing the loss of power that occurs during the transfer of these efforts from the leg to the ski due to the unavoidable plays.

The performance/cost ratio of the sports shoe is thus maximized, because a better response in effort transmission is combined with the possibility to limit the use of material with high technical characteristics only to the regions affected by the force transmission, thereby also reducing the bulk of the regions of the boot that are not dynamically stressed.

An important advantage of the shoe according to the invention, is that it can be implemented in several sports, such as roller skating, ice skating, mountain climbing, etc.

According to the embodiments of the invention described above, the rigid reinforcing frame may be arranged internally or inside the shell and/or quarter of the sports shoe, or alternatively the rigid reinforcing frame may be arranged externally or outside the shell and/or quarter of the sports shoe. Thus, according to the invention, the rigid reinforcing frame is arranged internally nearer the inside of the shoe with respect to the respective boot soft portion, or alternatively, the rigid reinforcing frame is arranged externally farther from the inside of the shoe with respect to the respective boot soft portion. The particular embodiment shown in FIGS. 14–20 shows the first and second rigid reinforcing frames 604 and 605 arranged internally with respect to the first and second soft covering elements 615 and 616 respectively. It is alternatively possible to inject in place or associate the first and second rigid reinforcing frames externally with respect to the first and second soft covering elements. In this case, the first and second rigid reinforcing elements and the first and second soft covering elements have essentially the same shape and configuration as has already been described and as is shown in the FIGS. 14–20, except that the various elements are sized accordingly such that the first and second rigid reinforcing elements are arranged externally to the first and second soft covering elements with respect to the inside of the sports shoe.

The materials and the dimensions that constitute the individual components of the boot may naturally be the most pertinent according to the specific requirements.

What is claimed is:

1. A sports shoe having an inside, a heel region, a region lying above the heel region, a tip region, a foot instep region, a foot inner side region, and a foot outer side region, the sports shoe comprising:

a sole having a resting surface;

a shell connected to the sole;

a shell rigid reinforcing frame; and a shell soft portion connected to said shell rigid reinforcing frame for forming said shell, said shell soft portion being relatively less rigid than said shell rigid reinforcing frame;

said reinforcing frame comprising bands of plastic material extending at least along a first inclined directrix and a second inclined directrix such that open regions are defined in said shell reinforcing frame, in which said first inclined directrix extends at least at one of the foot inner side region and the foot outer side region from the tip region towards the region lying above the heel region and such that said first inclined directrix is inclined with respect to the extension of said sole, and in which said second inclined directrix also extends at least at said one of the foot inner side region and the foot outer side region from the heel region towards the foot instep region and such that said second inclined directrix is inclined with respect to the extension of said sole;

the bands of plastic material of said reinforcing frame which extend along said first directrix and said second directrix being mutually connected at an intersection point of said first and second directrices; and said open regions of said reinforcing frame comprising at least:

a first region arranged at least at said one of the foot inner side region and the foot outer side region laterally and adjacent to the region lying above the heel region; and a second region arranged at least at said one of the foot inner side region and the foot outer side region in a median zone between the tip region and the heel region and just above said sole; and wherein said shell rigid reinforcing frame is arranged inside the shell soft portion.

2. The sports shoe of claim 1 wherein said reinforcing frame comprises a rear band of plastics material extending along a rear directrix which extends from the heel region to the region lying above the heel region, said rear band being connected at the heel region to the band extending along said second directrix, and said rear band being connected at the region lying above the heel region to the band extending along said first directrix.

3. The sports shoe of claim 1 wherein said reinforcing frame comprises a front band of plastic material arranged at the tip region, said front band being connected at the tip region to the band extending along said first directrix.

4. The sports shoe of claim 3 wherein said open regions of said shell reinforcing frame further comprise a third region arranged at said one of the foot inner side region and the foot outer side region at a forward zone just above said sole adjacent the tip region.

5. The sports shoe of claim 1 wherein said reinforcing frame comprises a rear band of plastics material extending along a rear directrix which extends from the heel region to the region lying above the heel region, said rear band being connected at the heel region to the band extending along said second directrix, and said rear band being connected at the region lying above the heel region to the band extending along said first directrix, and wherein said reinforcing frame comprises a front band of plastics material arranged at the tip region, said front band being connected at the tip region to the band extending along said first directrix.

6. The sports shoe of claim 5 wherein said open regions of said reinforcing frame further comprise a third region arranged at said one of the foot inner side region and the foot outer side region at a forward zone just above said sole adjacent the tip region.

7. The sports shoe of claim 1 wherein said reinforcing frame comprises bands of plastic material extending along a pair of first inclined directrices each of which extends at a respective one of the foot inner side region and the foot outer side region from the tip region towards the region lying above the heel region and along a pair of second inclined directrices each of which extends at a respective one of the foot inner side region and the foot outer side region from the heel region towards the foot instep region, and wherein said open regions of said reinforcing frame comprise a pair of first regions each arranged respectively at the foot inner side region and the foot outer side region laterally and adjacent to the region lying above the heel region; and a pair of second regions each arranged respectively at the foot inner side region and the foot outer side region in median zones between the tip region and the heel region and just above said sole.

8. The sports shoe of claim 7 wherein said reinforcing frame comprises a rear band of plastics material extending along a rear directrix which extends from the heel region to the region lying above the heel region, said rear band being connected at the heel region to both of the bands extending along said pair of second directrices, and said rear band being connected at the region lying above the heel region to both the bands extending along said pair of first directrices.

9. The sports shoe of claim 8 wherein said reinforcing frame comprises a front band of plastic material arranged at the tip region, said front band being connected at the tip region to both of the bands extending along said pair of first directrices.

10. The sports shoe of claim 9 wherein said open regions of said shell reinforcing frame further comprise a pair of third regions each arranged respectively at the foot inner side region and the foot outer side region at forward zones just above said sole adjacent the tip region.

11. The sports shoe of claim 7 wherein said reinforcing frame comprises a rear band of plastics material extending along a rear directrix which extends from the heel region to the region lying above the heel region, said rear band being connected at the heel region to both of the bands extending along said pair of second directrices, and said rear band being connected at the region lying above the heel region to both the bands extending along said pair of first directrices, and wherein said reinforcing frame comprises a front band of plastics material arranged at the tip region, said front band being connected at the tip region to both of the bands extending along said pair of first directrices.

12. The sports shoe of claim 11 wherein said open regions of said reinforcing frame further comprise a pair of third regions each arranged respectively at the foot inner side region and the foot outer side region at forward zones just above said sole adjacent the tip region.

13. A sports shoe having an inside, a heel region, a region lying above the heel region, a tip region, a foot instep region, a foot inner side region, and a foot outer side region, the sports shoe comprising:

a sole having a resting surface;

a shell connected to the sole, a shell rigid reinforcing frame; and a shell soft portion connected to said shell rigid reinforcing frame for forming said shell, said shell soft portion being relatively less rigid than said shell rigid reinforcing frame;

said reinforcing frame comprising bands of plastic material extending at least along a first inclined directrix and a second inclined directrix such that open regions are defined in said shell reinforcing frame, in which said first inclined directrix extends at least at one of the foot inner side region and the foot outer side region from the tip region towards the region lying above the heel region and such that said first inclined directrix is inclined with respect to the extension of said sole, and in which said second inclined directrix also extends at least at said one of the foot inner side region and the foot outer side region from the heel region towards the foot instep region and such that said second inclined directrix is inclined with respect to the extension of said sole;

the bands of plastic material of said reinforcing frame which extend along said first directrix and said second directrix being mutually connected at an intersection point of said first and second directrices; and said open regions of said reinforcing frame comprising at least:

a first region arranged at least at said one of the foot inner side region and the foot outer side region laterally and adjacent to the region lying above the heel region; and a second region arranged at least at said one of the foot inner side region and the foot outer side region in a median zone between the tip region and the heel region and just above said sole; and wherein said shell rigid reinforcing frame is arranged outside the shell soft portion.

14. The sports shoe of claim 1 further comprising:

at least one quarter associated with said shell;

a quarter rigid reinforcing frame; and a quarter soft portion connected with said quarter rigid reinforcing frame for forming said quarter, said quarter soft portion being relatively less rigid than said quarter rigid reinforcing frame;

said quarter rigid reinforcing frame comprising bands of plastics material extending along opposite lateral areas such that a pair of open lateral regions are defined in said quarter reinforcing frame and which are delimited by the bands extending at the opposite lateral areas.

15. The sports shoe of claim 14 wherein said quarter reinforcing frame comprises a band of plastic material extending along said rear directrix at a calf region of the shoe such that the band extending at the rear directrix is connected to both the bands extending at the opposite lateral areas and such that the pair of open lateral regions of said quarter reinforcing frame are delimited by the bands extending at the opposite lateral areas and by the band extending at the rear directrix.

16. The sports shoe of claim 14 wherein an open calf region is defined at a calf region of the shoe which is connected to the pair of open lateral regions such that a single open region is defined which comprises said open calf region and said pair of open lateral regions, and such that said single open region is delimited by said bands of plastics material extending along opposite lateral areas.

17. The sports shoe of claim 14 further comprising means for adjustably and slidably connecting said quarter rigid frame to said quarter soft portion.

18. The sports shoe of claim 14 wherein said quarter rigid reinforcing frame is arranged internally nearer the inside of the shoe with respect to the quarter soft portion.

19. The sports shoe of claim 13 further comprising:

at least one quarter associated with said shell;

a quarter rigid reinforcing frame; and a quarter soft portion connected with said quarter rigid reinforcing frame for forming said quarter, said quarter soft portion being relatively less rigid than said quarter rigid reinforcing frame;

said quarter rigid reinforcing frame comprising bands of plastics material extending along opposite lateral areas such that a pair of open lateral regions are defined in said quarter reinforcing frame and which are delimited by the bands extending at the opposite lateral areas.

20. The sports shoe of claim 19 wherein said quarter reinforcing frame comprises a band of plastic material extending along said rear directrix at a calf region of the shoe such that the band extending at the rear directrix is connected to both the bands extending at the opposite lateral areas and such that the pair of open lateral regions of said quarter reinforcing frame are delimited by the bands extending at the opposite lateral areas and by the band extending at the rear directrix.

21. The sports shoe of claim 19 wherein an open calf region is defined at a calf region of the shoe which is connected to the pair of open lateral regions such that a single open region is defined which comprises said open calf region and said pair of open lateral regions, and such that said single open region is delimited by said bands of plastics material extending along opposite lateral areas.

22. The sports shoe of claim 19 further comprising means for adjustably and slidably connecting said quarter rigid frame to said quarter soft portion.

23. The sports shoe of claim 13 wherein said shell soft portion is a first soft internal element outside of which said shell rigid reinforcing frame is arranged.

24. The sports shoe of claim 23 wherein said rigid reinforcing frame is connected with said sole and wherein said reinforcing frame and said sole cover said soft internal element.

25. The sports shoe of claim 14 wherein said shell soft portion is a first soft internal element outside of which said shell rigid reinforcing frame is arranged, and wherein said quarter soft portion is a second soft internal element outside of which said quarter rigid reinforcing frame is arranged, and wherein said shell rigid reinforcing frame is connected with said sole and wherein said reinforcing frame and said sole cover said soft internal element.

26. The sports shoe of claim 1 wherein said sole has bands of material extending along a third directrix and a fourth directrix, and openings without material arranged between said bands of material of said sole, said third and fourth directrices having an essentially concave shape and being arranged mutually opposite and extending respectively from the heel region to a first metatarsal bone region and to a fifth metatarsal bone region.

27. The sports shoe of claim 1 wherein said shell rigid reinforcing frame comprises an essentially V-shaped monolithic frame having a first leg corresponding to the band extending along the first directrix and a second leg corresponding to the band extending along the second directrix.

28. The sports shoe of claim 27 wherein said monolithic frame is connected at the foot inner side region.

29. The sports shoe of claim 27 further comprising means for connecting the bottom ends of said first and second legs to said sole.

30. The sports shoe of claim 29 further comprising means for connecting the vertex of the monolithic frame to a malleolar region of the shoe.

31. The sports shoe of claim 27 further comprising tabs extending from the bottom ends of said first and second legs, said tabs being connected inside slots arranged in said sole.

32. The sports shoe of claim 31 further comprising means for connecting the vertex of the monolithic frame to a malleolar region of the shoe.

33. The sports shoe of claim 1 wherein said shell rigid reinforcing frame comprises an essentially Y-shaped frame having a first leg corresponding to the band extending along the first directrix and a second leg corresponding to the band extending along the second directrix and a third leg extending upwardly from the vertex of said first and second legs, said third leg being a band of plastics material extending along a lateral directrix of a quarter of the shoe.

34. The sports shoe of claim 33 wherein said Y-shaped frame is connected at the foot inner side region.

35. The sports shoe of claim 34 further comprising means for connecting the bottom ends of said first and second legs to said sole.

36. The sports shoe of claim 37 further comprising means for connecting the vertex of the first and second legs to a malleolar region of the shoe, and means for connecting an upper end of said third leg to the quarter.

37. The sports shoe of claim 33 further comprising tabs extending from the bottom ends of said first and second legs, said tabs being connected inside slots arranged in said sole.

38. The sports shoe of claim 35 further comprising means for connecting the vertex of the first and second legs to a malleolar region of the shoe.

39. The sports shoe of claim 13 wherein said reinforcing frame comprises a rear band of plastics material extending along a rear directrix which extends from the heel region to the region lying above the heel region, said rear band being connected at the heel region to the band extending along said second directrix, and said rear band being connected at the region lying above the heel region to the band extending along said first directrix.

40. The sports shoe of claim 13 wherein said reinforcing frame comprises a front band of plastic material arranged at the tip region, said front band being connected at the tip region to the band extending along said first directrix.

41. The sports shoe of claim 40 wherein said open regions of said shell reinforcing frame further comprise a third region arranged at said one of the foot inner side region and the foot outer side region at a forward zone just above said sole adjacent the tip region.

42. The sports shoe of claim 13 wherein said reinforcing frame comprises a rear band of plastics material extending along a rear directrix which extends from the heel region to the region lying above the heel region, said rear band being connected at the heel region to the band extending along said second directrix, and said rear band being connected at the region lying above the heel region to the band extending along said first directrix, and wherein said reinforcing frame comprises a front band of plastics material arranged at the tip region, said front band being connected at the tip region to the band extending along said first directrix.

43. The sports shoe of claim 42 wherein said open regions of said reinforcing frame further comprise a third region arranged at said one of the foot inner side region and the foot outer side region at a forward zone just above said sole adjacent the tip region.

44. The sports shoe of claim 13 wherein said reinforcing frame comprises bands of plastic material extending along a pair of first inclined directrices each of which extends at a respective one of the foot inner side region and the foot outer side region from the tip region towards the region lying above the heel region and along a pair of second inclined directrices each of which extends at a respective one of the foot inner side region and the foot outer side region from the heel region towards the foot instep region, and wherein said open regions of said reinforcing frame comprise a pair of first regions each arranged respectively at the foot inner side region and the foot outer side region laterally and adjacent to the region lying above the heel region; and a pair of second regions each arranged respectively at the foot inner side region and the foot outer side region in median zones between the tip region and the heel region and just above said sole.

45. The sports shoe of claim 44 wherein said reinforcing frame comprises a rear band of plastics material extending along a rear directrix which extends from the heel region to the region lying above the heel region, said rear band being connected at the heel region to both of the bands extending along said pair of second directrices, and said rear band being connected at the region lying above the heel region to both the bands extending along said pair of first directrices.

46. The sports shoe of claim 45 wherein said reinforcing frame comprises a front band of plastic material arranged at the tip region, said front band being connected at the tip region to both of the bands extending along said pair of first directrices.

47. The sports shoe of claim 46 wherein said open regions of said shell reinforcing frame further comprise a pair of third regions each arranged respectively at the foot inner side region and the foot outer side region at forward zones just above said sole adjacent the tip region.

48. The sports shoe of claim 44 wherein said reinforcing frame comprises a rear band of plastics material extending along a rear directrix which extends from the heel region to the region lying above the heel region, said rear band being connected at the heel region to both of the bands extending along said pair of second directrices, and said rear band being connected at the region lying above the heel region to both the bands extending along said pair of first directrices, and wherein said reinforcing frame comprises a front band of plastics material arranged at the tip region, said front band being connected at the tip region to both of the bands extending along said pair of first directrices.

49. The sports shoe of claim 48 wherein said open regions of said reinforcing frame further comprise a pair of third regions each arranged respectively at the foot inner side region and the foot outer side region at forward zones just above said sole adjacent the tip region.

50. The sports shoe of claim 19 wherein said quarter rigid reinforcing frame is arranged outside the quarter soft portion.

51. The sports shoe of claim 1 wherein said shell soft portion is a first soft external element inside of which said shell rigid reinforcing frame is accommodated.

52. The sports shoe of claim 51 wherein said rigid reinforcing frame is connected with said sole and wherein said first soft external element essentially completely covers said sole and said reinforcing frame.

53. The sports shoe of claim 14 wherein said shell soft portion is a first soft external element inside of which said shell rigid reinforcing frame is accommodated, and wherein said quarter soft portion is a second soft external element inside of which said quarter rigid reinforcing frame is accommodated, and wherein said rigid reinforcing frame is connected with said sole and said first soft external element essentially completely covers said sole and said reinforcing frame.

54. The sports shoe of claim 30 wherein said sole has bands of material extending along a third directrix and a fourth directrix, and openings without material arranged between said bands of material of said sole, said third and fourth directrices having an essentially concave shape and being arranged mutually opposite and extending respectively from the heel region to a first metatarsal bone region and to a fifth metatarsal bone region.

55. The sports shoe of claim 13 wherein said shell rigid reinforcing frame comprises an essentially V-shaped monolithic frame having a first leg corresponding to the band extending along the first directrix and a second leg corresponding to the band extending along the second directrix.

56. The sports shoe of claim 55 wherein said monolithic frame is connected at the foot inner side region.

57. The sports shoe of claim 55 further comprising means for connecting the bottom ends of said first and second legs to said sole.

58. The sports shoe of claim 29 further comprising means for connecting the vertex of the monolithic frame to a malleolar region of the shoe.

59. The sports shoe of claim 55 further comprising tabs extending from the bottom ends of said first and second legs, said tabs being connected inside slots arranged in said sole.

60. The sports shoe of claim 59 further comprising means for connecting the vertex of the monolithic frame to a malleolar region of the shoe.

61. The sports shoe of claim 13 wherein said shell rigid reinforcing frame comprises an essentially Y-shaped frame having a first leg corresponding to the band extending along the first directrix and a second leg corresponding to the band extending along the second directrix and a third leg extending upwardly from the vertex of said first and second legs, said third leg being a band of plastics material extending along a lateral directrix of a quarter of the shoe.

62. The sports shoe of claim 61 wherein said Y-shaped frame is connected at the foot inner side region.

63. The sports shoe of claim 62 further comprising means for connecting the bottom ends of said first and second legs to said sole.

64. The sports shoe of claim 63 further comprising means for connecting the vertex of the first and second legs to a malleolar region of the shoe.

65. The sports shoe of claim 61 further comprising tabs extending from the bottom ends of said first and second legs, said tabs being connected inside slots arranged in said sole.

66. The sports shoe of claim 65 further comprising means for connecting the vertex of the first and second legs to a malleolar region of the shoe, and means for connecting an upper end of said third leg to the quarter.

* * * * *